United States Patent [19]

Urlberger

[11] 4,406,563

[45] Sep. 27, 1983

[54] PROTECTIVE BARRIER PROVIDED WITH AT LEAST ONE LONGITUDINAL SIDE BAR

[76] Inventor: Hermann H. Urlberger, Gutwerkstrabe 45, Aschaffenburg, Fed. Rep. of Germany

[21] Appl. No.: 249,333

[22] Filed: Mar. 30, 1981

[51] Int. Cl.[3] ..... E01F 13/00

[52] U.S. Cl. ..... 404/6; 256/13.1

[58] Field of Search ..... 404/6, 9; 256/13.1

[56] References Cited

U.S. PATENT DOCUMENTS

| | | | |
|---|---|---|---|
| 1,606,588 | 11/1926 | Meermans | 256/13.1 |
| 1,677,038 | 7/1928 | Lookabaugh | 256/13.1 |
| 1,680,548 | 8/1928 | Keiser | 404/6 X |
| 1,927,189 | 9/1933 | Sory | 256/13.1 |
| 3,332,666 | 7/1967 | Gray | 404/6 X |
| 3,390,865 | 7/1968 | Jehu | 256/13.1 |
| 3,591,144 | 7/1971 | Iving | 404/6 |
| 3,678,815 | 7/1972 | Younker | 404/6 X |
| 3,877,681 | 4/1975 | Humphrey | 404/6 X |
| 3,982,735 | 9/1976 | Fornells | 256/13.1 X |
| 4,190,380 | 2/1980 | Almer | 404/6 |
| 4,249,832 | 2/1981 | Schmanski | 404/6 |

FOREIGN PATENT DOCUMENTS

| | | |
|---|---|---|
| 1784719 | 11/1971 | Fed. Rep. of Germany . |
| 2753918 | 6/1979 | Fed. Rep. of Germany . |
| 1209646 | 10/1970 | United Kingdom . |

*Primary Examiner*—Nile C. Byers, Jr.

[57] ABSTRACT

A transportable barrier to vehicle traffic, having a prefabricted base shaped to deflect the collision of a vehicle, and vertical pillars supporting at least one longitudinal side bar above the base, the longitudinal side bar positioned to cushion the collision of a vehicle.

12 Claims, 8 Drawing Figures

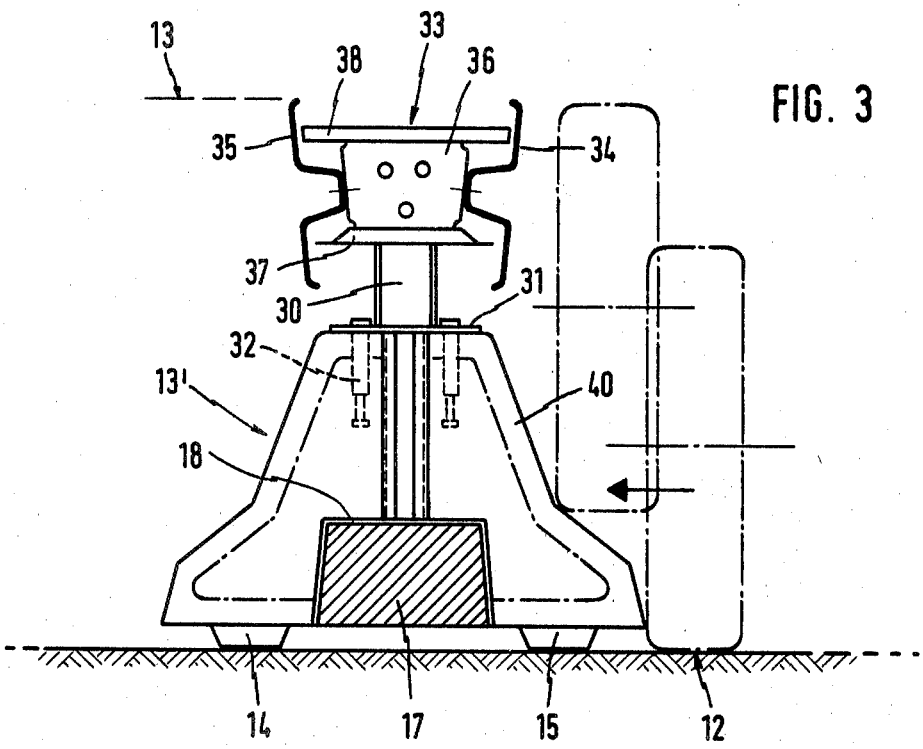
FIG. 3
FIG. 4
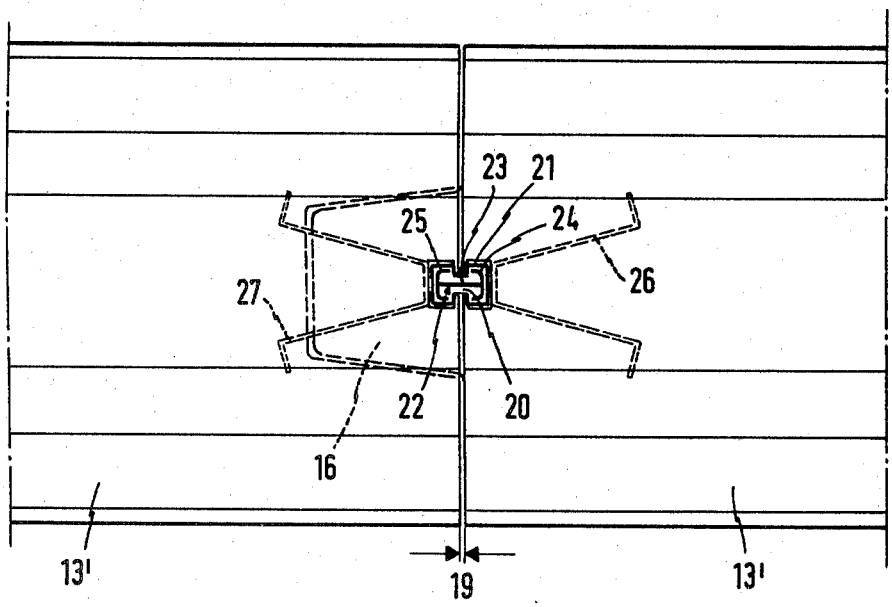

FIG. 6
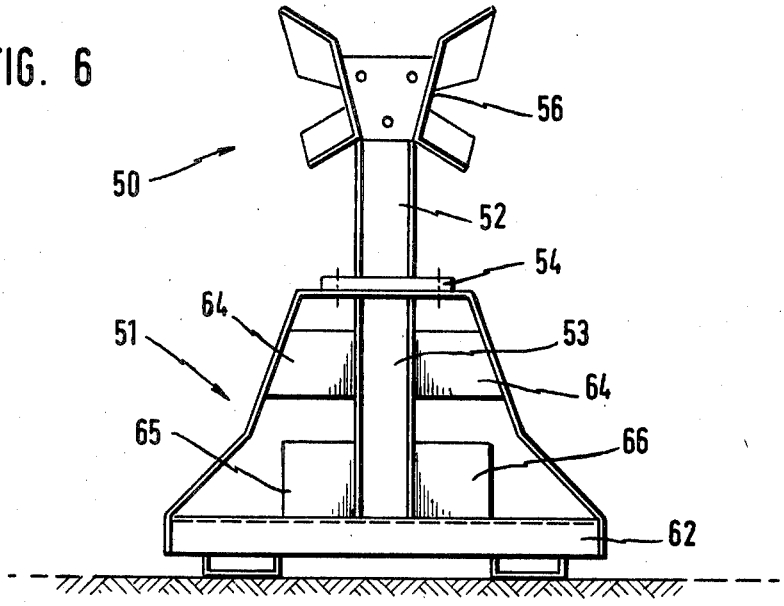
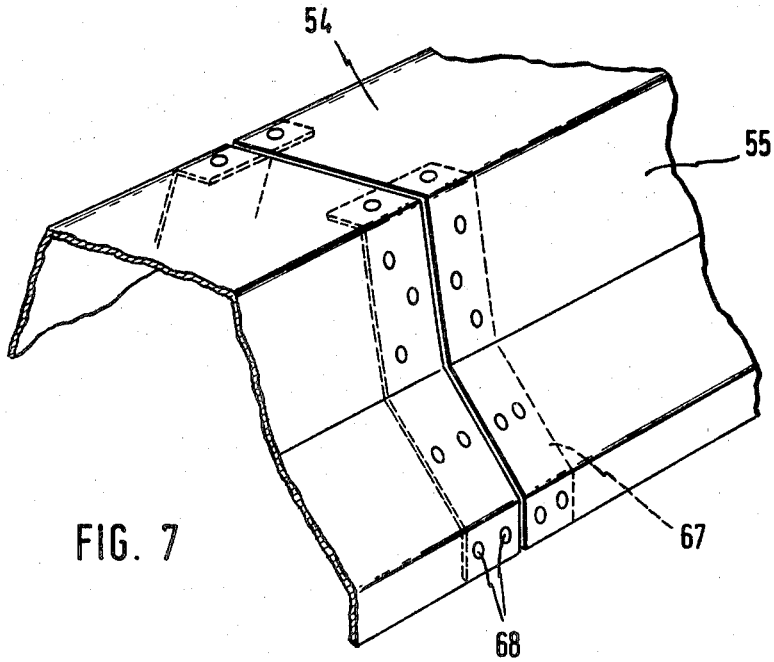
FIG. 7

PROTECTIVE BARRIER PROVIDED WITH AT LEAST ONE LONGITUDINAL SIDE BAR

BACKGROUND OF THE INVENTION

The invention relates to a protective barrier which can be assembled on the spot and is provided with at least one longitudinal side bar.

The German Utility Model Pat. No. 7,439,869 has made known a protective barrier which can be composed of prefabricated reinforced concrete parts and has a base member which is 2 m wide and an overall height of 1.20 m. Longitudinal side bars are attached to the center portion of this protective barrier, which center portion is provided with parallel walls; said longitudinal side bars being buffered in the center approximately by rubber shock absorbers. Consequently, this known protective barrier has the same effect as a usual protective steel barrier system. It is furthermore known to prepare deflection walls made of concrete and being 70 to 90 cm high on the spot; in case of these known deflection walls, however, it cannot be excluded that small or large vehicles, such as trucks, run over the system when there is a violent collision.

SUMMARY OF THE INVENTION

The invention has been based on the problem to provide a protective barrier of the initially mentioned type where the transportable system on the spot is sufficiently capable of guaranteeing safety even when the vehicle runs against the protective system with a relatively high collision energy.

The problem is solved in that according to the invention there extend approximately vertically from the top of the prefabricated parts pillars or the like supporting at least one longitudinal side member.

What is achieved by the combination of the steel barrier with the prefabricated parts which are constructed as independent collision device is, on the one hand, that after disassembling of the steel barrier the prefabricated parts can be re-used unchanged and, on the other hand, that due to the special construction of the prefabricated parts, when a vehicle collides with the protective system, the initial repelling effect of the prefabricated parts in the upper region is changed into a kind of cushion effect—as a result of the plastic deformability of the steel board.

When a protective steel barrier system or a protective barrier system are combined with a "deflection system" consisting of prefabricated parts, there are possible various combinations, especially since this combined system is not only suitable for median strips—i.e. so-called double systems—but also for use at the side of the road—i.e. as so-called single system. According to a preferred embodiment, the prefabricated parts can be made of concrete, preferably of reinforced concrete; according to another preferred embodiment, the prefabricated parts can consist of steel plates shaped like a cap and of at least one spacer inwardly supporting the side walls.

In the latter case, not only weight is saved but also the possibility of transport is facilitated. Whereas in case of the prefabricated concrete parts the repelling is inelastic, the prefabricated parts consisting of steel plates are also by themselves elastic or even deformable to a certain extent.

Further features of the protective barrier result from the claims and from the following specification.

BRIEF DESCRIPTION OF THE DRAWINGS

The drawing shows exemplifying embodiments of the invention and their use; below they will be described in more detail; there is shown in FIG. 1—a cross-section through an autobahn having three lanes, FIG. 2—a cross-section through the same stretch of autobahn while using an embodiment of the invention, FIG. 3—a cross-section through an embodiment of the invention, FIG. 4—a top view onto two coupled prefabricated parts without protective barrier system, FIG. 5—an embodiment of the invention modified as compared with FIG. 3, FIG. 6—a cross-section through another embodiment, FIG. 7—an oblique view onto a detail of the embodiment as shown in FIG. 6, FIG. 8—also an oblique view onto the embodiment shown in FIGS. 6 and 7.

DESCRIPTION OF THE PREFERRED EMBODIMENT

Figure 1:
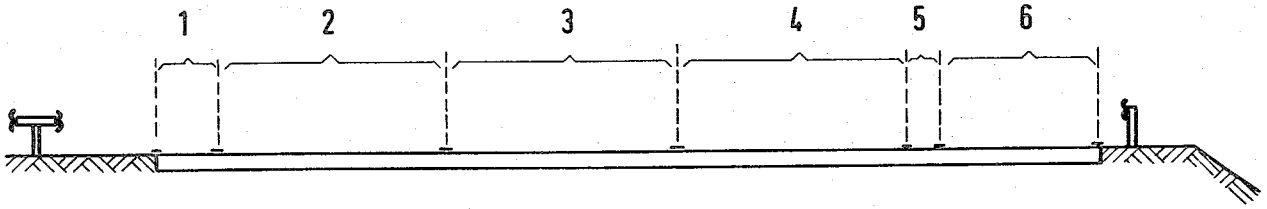
Figure 2:
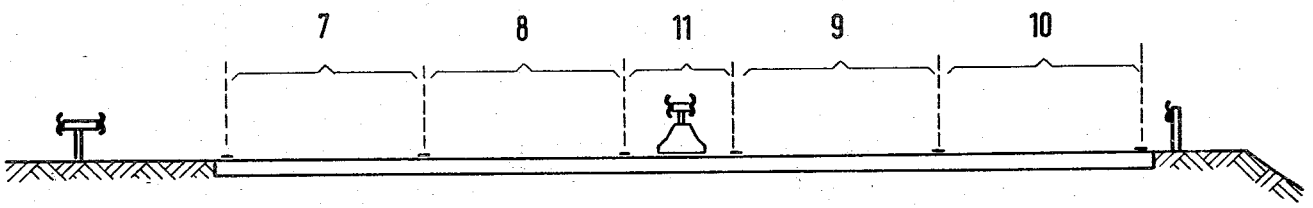

In case of a normal cross-section through a roadway of an autobahn having three lanes and a lay-bye it is assumed that at a distance of about 2 meters (m) from the central steel barrier, there are a marginal strip 1 of a width of 1 m, three lanes 2, 3, 4 having each a width of 3.75 m, a marginal strip 5 having a width of 50 centimeters (cm) and a passable lay-bye 6 having a width of 2.50 m. At the periphery of the roadway, there is again provided a steel barrier of conventional construction.

In order to modify the standard cross-section of the three-lane autobahn for an oncoming traffic, for example because there are road construction sites, there are again in the direction of traffic two lanes 7 and 8 each having a width of 3.25 m and for the oncoming traffic lanes 9 and 10 having the same width. In the intermediate section 11 having a width of 1.75 m, there is mounted into position the protective barrier comprising prefabricated parts as hereinafter described in more detail.

Such a protective barrier includes a transportable "foundation" which has, for example, a maximum width of 80 cm and a height of 90 cm from the ground 12 to the upper edge 13 of the longitudinal side bars. (see FIG. 3)

The "base" consists (FIGS. 1 to 5) of prefabricated concrete parts 13' having a length of 2 m and a height of nearly 50 cm measured from the ground 12. The prefabricated concrete parts 13' are put on small feet 14, 15 so that rain water is permitted to flow through under the prefabricated concrete parts. Each prefabricated concrete part has on its front side a peg-shaped projection 16 which at its bottom surface has a width of about 30 cm and at its free edge a width of about 22 cm. The projection has a length of about 25 cm, is tapering and has the same thickness of about 16 cm; at its bottom surface 17, it is about 4 cm wider than at its surface 18, as can be seen from FIG. 3.

As can also be seen from FIG. 4, at the rear side of the adjacent prefabricated concrete part, there is provided a correspondingly constructed recess so that e.g. a crane can lift the prefabricated concrete parts into their final position, thus forming a chain. The joint gap 19 in practice is about 3 mm so that movability between the individual prefabricated concrete parts put, for example, on the ground 12 or roadway is permitted.

In order to increase the chain-like connection of the individual prefabricated concrete parts, each prefabricated concrete part has at its front wall a perpendicular slit 20 provided up to the surface 18. This slit 20 is undercut and surrounded by a C-shaped form 21.

When the prefabricated concrete parts have been assembled, a profile bar 22 is inserted from the top or crown of the prefabricated concrete parts. This profile bar has a web 23 extending vertically to the joint 19 and legs 24 and 25 welded to the edges of the profile bar. In case of this bar which is similar to a double-T-bar, however, the legs 24 and 25 are rounded, as can be seen from FIG. 4, so as to make possible slight dislocation of the individual prefabricated concrete parts at the height of the joint after collision of a vehicle.

The C-shaped bars 21 are anchored in the prefabricated concrete parts by means of reinforcing iron bars 26 and 27.

For example, in the middle portion between two joints 19, at each individual or only at each second prefabricated concrete part, a double-T-rail-shaped support 30 is via a plate 31 and screw bolts 32 secured on the crown or top of the prefabricated concrete part. These supports in general carry a steel board which in general is indicated by the reference numeral 33.

In the drawn exemplifying embodiment, two mirror-symmetrical longitudinal bars 34 and 35 are connected to the support or pillar 30 via spacer pieces 36 so as to be mirror-inverted. As can be seen from FIG. 3, said longitudinal bars are constructed to be inclined by about 10° to 12°; the spacer 37 provided in the lower region of the longitudinal side bars 34 and 35 is softer or more easily deformable than the spacer 38 provided in the upper region of the longitudinal side bars 34 and 35. The longitudinal side bars can of course extend also vertically.

The inclination of the longitudinal side bars relative to the vertical line can be up to 30° so as to increase, if necessary, the cushion effect on the vehicle "driving upwards" on the surface 40 of the prefabricated concrete parts and to prevent the vehicle from being hurled back onto the roadway or from running over the protective barrier.

When a vehicle collides with the repelling or cushioning system of the described type, there occur the following effects.

In dependence on the strength of the collision, the prefabricated concrete part having a weight of about 1.2 tons is displaced only slightly or not at all; depending on the angle of impact of the colliding vehicle, the latter is forced upwards on the surface 40 and is "caught" by the plastically deformable protective steel barrier system. It is not possible that a vehicle runs over the steel board, even if said vehicle is an especially heavy one, such as for example a motor truck or a bus. An especially violent collision could at most result in that the prefabricated concrete parts are damaged and the steel board is forced away. In comparison with a concrete deflection wall consisting only of prefabricated concrete parts, the repelling effect is a reduced one, whereas the "cushion effect" is decisively greater.

Figure 5:
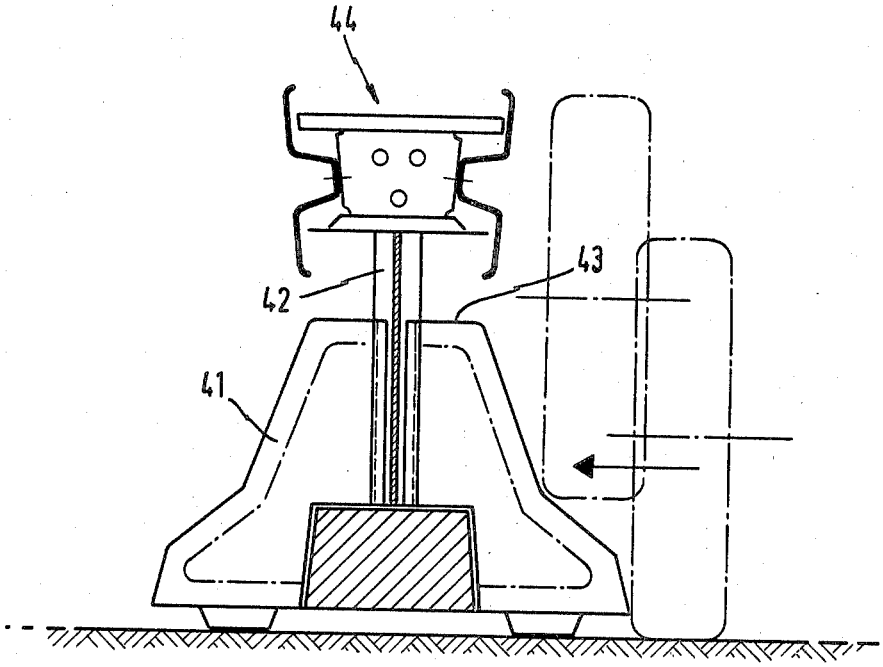

According to the embodiment which is modified and is shown in FIG. 5, only a different support for the steel board system is provided, whereas the prefabricated concrete parts 41 are of the same construction.

Instead of the bar 22 as shown in FIG. 4, in the embodiment of FIG. 5 there is provided a double-T-support 42 which extends beyond the crown 43 of the prefabricated concrete parts and is constructed to serve simultaneously as a holder or pillar for the steel board system 44; the latter has the same properties and constructional features as described in connection with FIGS. 3 and 4.

It is obvious that the described protective barrier system, which can be transposed, can be provided with only one longitudinal side bar and therefore is effective only on one side; it is also possible that the steel board system in certain circumstances is provided without spacer pieces. It is also obvious that the steel board system can be connected to the prefabricated concrete parts via pillars which, on the one hand, are anchored in the prefabricated concrete parts and, on the other hand, are constructed as coupling members.

The individual straight and plane side wall portions of the prefabricated concrete parts can have the following degrees of angle, each relating to the vertical line: the lower narrow portion with which the vehicle wheels collide can have e.g. a height of 9 cm and an angle of 14°, the central side wall portion extending angularly thereto can have a height of about 10 cm and an angle of 51°; finally, the upper side wall portion 40 can have a height of about 29 cm and an angle of about 20°.

The above mentioned opposed inclination of the longitudinal side bar 34 and 35 relative to the vertical line whould at least be 10 angular degrees; however, an opposed inclination of about 20° is preferred.

The individual prefabricated concrete parts are conditioned such that in cross-wise arrangement they can easily be stacked, the protective steel barrier, however, has to be transported separately; the pillars, as far as they are anchored in the prefabricated concrete parts, can be anchored in the concrete or mounted on the crown before the transport.

Figure 8:
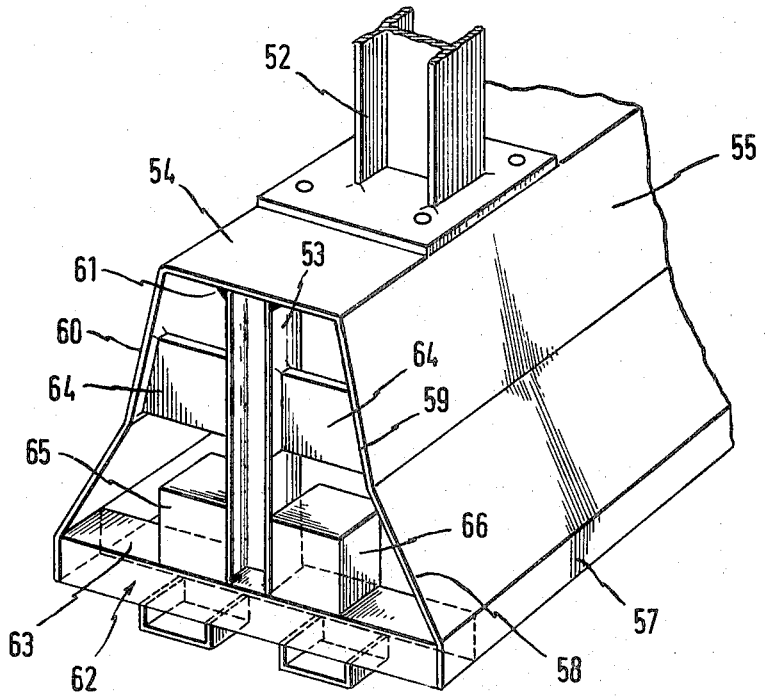

In case of the embodiment shown in FIGS. 6 to 8, which embodiment is further modified, the steel barrier 50 is mounted on a prefabricated part 51 made of steel plates which is cap-shaped in cross-section. Even if—as hereinafter described in more detail—the individual pillars 52 of the steel barrier 50 is offset relative to the pillar 53 of the prefabricated part 51, which pillar 53 has to be described in more detail, it is of course also possible to provide the top plate 54 of the prefabricated part with an opening so that the two pillars 52 and 53 are in one piece.

Whereas the individual plate portions 55 of the prefabricated part are for example 2 m long, the steel barrier can be twice as long, i.e. it can consist of component parts having a length of 4 m; it is of course also possible to compose the steel barrier only of longitudinal bars 56 having a length of 2 m.

Referring to FIG. 8, a plate 55 made of steel for the prefabricated part includes a vertical portion 57 having a height of about 8 cm, an oblique portion 58 connected thereto and having an angle of 45° relative to the horizontal line, and an upper portion 59 which extends at an angle of 65° relative to the horizontal line. The overall height of the base is about 45 cm, and the steel barrier possibly mounted thereon has the same height so that the whole system has an overall height of about 90 cm.

A plate 60 is mirror-symmetrically provided to the plate 55 (in case of a protective double barrier system), both plates being firmly connected to each other by the top plate 54. Pillar 53 is welded to top plate 54 at 61.

At the foot of the two plates 59, 60 are provided long spacers 62 which for example have a U profile whose web 63 points to the plate 54. This long spacer has a length of nearly 70 cm.

The pillar 53 is centrally secured on the web 63; said pillar in the usual manner consists of a double-T-profile.

At a distance of about 12 to 15 cm from the web 63 of the long lower spacer 62, there is provided a further spacer 64 which consists of two parts extending laterally from the pillar 53 in the direction towards the plate 55 or 60 and are welded, on the one hand, to the respective plates and, on the other hand, to the pillar 53.

There are put on the web 63, if necessary also while using an adjacent spacer, small boxes or containers 65, 66 which can receive ballast, thereby contributing to arrest the protective barrier. It is obvious that this ballast can consist of any desired weighty material; however, scrap can readily be also used.

As can be seen from FIG. 7, the individual prefabricated part units, which for example have a length of 2 m, at their joints are interconnected firmly by washer strips 67 which have the profile of the plates and are secured each to the latter by screwed bolts 68; in order to additionally secure the screwed bolts, washers are used on the side facing the interior.

As a result of the plates 55, 60 being made of steel, the sliding between the colliding wheels of a vehicle and the barrier—as compared with concrete barriers—is decisively reduced, whereby too fast a climbing up of the wheel(s) on the prefabricated part is avoided.

The different inclinations of the portions 57, 58, 59 of the plate 55 serve to cause the driver, on colliding with the protective barrier, to realize "suddenly" the colliding effect. That is to say, the vertical portion 57, in case of a weak collision, prevents the vehicle from driving upwards at all on the prefabricated part since the wheel will slide along said surface. The portion 58, which extends at an angle of e.g. 45°, as the next step in case of a stronger collision, causes the driver by a jerk or by the driving noises being changed to realize which phase of collision he has arrived at, whereas the portion 59 with its gradient being steeper has to be considered as a transition to the genuine cushion effect provided in the steel barrier.

Due to the width of about 70 cm, the protective barrier, which can be easily assembled, needs only relatively little space while preventing vehicles from running over the barrier so that even if a vehicle collides violently with the barrier, at most a "bulge" in the protective barrier becomes "visible" to the drivers on the opposite lane; the steel barrier prevents vehicles from running over it and due to its deformability has the effect that colliding vehicles are only slightly "thrown back", if at all. In addition, overturning of the colliding vehicle is substantially prevented.

What is claimed is:

1. A protective roadway barrier adapted for assembly on a roadway by the interlocking of a plurality of base members in end-abutting relationship comprising (a) a plurality of base members, each of said base members having an elongate horizontal length and a generally inverted C-shaped cross-section wherein the bottom of said base member is substantially wider than the top of said base member and in a position elevate above the roadway, the surface of said base member formed of at least two plane sections having partial triangular cross-sections; and (b) a pillar adapted for interlocking coupling between two of said base members, said pillar projecting above the top of said base members; and (c) at least one elongate steel barrier plate, and means for connecting said barrier plate to said pillar at a position elevate above said base member.

2. The apparatus of claim 1, wherein said plane sections further comprise a first and lower section having steep-sided walls, an intermediate triangular section having walls inclined at an angle of approximately 45° relative to the horizontal, and a third and upper triangular section having steep-sided walls aligned at an angle exceeding 45° relative to the horizontal.

3. The apparatus of claim 2, wherein said means for connecting said elongate steel barrier plate to said pillar further comprises a brace member adapted for holding said barrier plate inclined toward said base member.

4. The apparatus of claim 1, further comprising end walls on said base members, and a vertical cavity extending along said end walls, and said pillar being adapted for insertion into said vertical cavities of two end-abutting base members, said pillar being adapted for holding said end-abutting base members together in interlocking relationship.

5. The apparatus of claim 4, wherein said vertical cavity further comprises an outer opening of predetermined width and an interior opening of predetermined greater width.

6. The apparatus of claim 5, wherein said pillar further comprises a cross-sectional shape adapted for vertical insertion into said cavity.

7. The apparatus of claim 6, wherein said means for connecting said elongate steel barrier plate to said pillar further comprises a brace member adapted for holding said barrier plate inclined toward said base member.

8. The apparatus of claim 7, wherein said C-shaped cross section of said base member further comprises three triangular plane sections.

9. The apparatus of claim 8, wherein said plane sections further comprise a first and lower section having steep-sided walls, an intermediate triangular section having walls inclined at an angle of approximately 45° relative to the horizontal, and a third and upper triangular section having steep-sided walls aligned at an angle exceeding 45° relative to the horizontal.

10. A prefabricated road barrier section adapted for end-abutting interconnection to a plurality of similar sections for assembly on a roadway and for carrying elevated and elongated deflection steel plates, comprising (a) a base member having vertical ends and having a cross-section shape formed by the joining together of four plane shapes, comprising:

(1) a first and lower shape having steep-sided walls symmetrically to the vertical;

(2) a second and intermediate triangular shape having walls symmetrically aligned at an angle of approximately 45° relative to the horizontal;

(3) a third and upper triangular shape having steep-sided walls symmetrically aligned at an angle exceeding 45° relative to the horizontal; and (4) a fourth shape being parallel to the roadway;

(b) at least one spacer interconnected between opposite walls of said base member;

(c) a pillar adapted for connection to at least said fourth shape, said pillar carrying at least one steel barrier plate at a position elevated above said base member.

11. The apparatus of claim 10, wherein said spacer further comprises means for holding a changeable ballast.

12. The apparatus of claim 11, wherein said means for holding further comprises open top containers adapted for positioning on said spacers.

* * * * *